US006536973B2

(12) United States Patent
DeLuca et al.

(10) Patent No.: US 6,536,973 B2
(45) Date of Patent: Mar. 25, 2003

(54) WRITING INSTRUMENT

(75) Inventors: Donald A. DeLuca, Guilford, CT (US); Daniel A. Ferrara, Jr., Morris, CT (US)

(73) Assignee: BIC Corporation, Milford, CT (US)

( * ) Notice: Subject to any disclaimer, the term of this patent is extended or adjusted under 35 U.S.C. 154(b) by 0 days.

(21) Appl. No.: 09/901,081

(22) Filed: Jul. 10, 2001

(65) Prior Publication Data

US 2003/0012593 A1 Jan. 16, 2003

(51) Int. Cl.[7] ..... B43K 7/12

(52) U.S. Cl. ..... 401/117; 401/99; 401/109

(58) Field of Search ..... 401/112, 117, 401/113, 114, 104, 99, 109, 110, 111

(56) References Cited

U.S. PATENT DOCUMENTS

| | | | | |
|---|---|---|---|---|
| 1,156,287 A | | 10/1915 | Harris | |
| 1,196,662 A | | 8/1916 | Chebrou et al. | |
| 1,590,394 A | | 6/1926 | Rawlings | |
| 1,774,819 A | | 9/1930 | Walters et al. | |
| 2,427,068 A | | 9/1947 | Randolph | 120/49 |
| 2,896,577 A | | 7/1959 | Merryman et al. | 120/42 |
| 2,988,054 A | | 6/1961 | Yates | 120/42 |
| 2,988,055 A | * | 6/1961 | Platt | 401/112 |
| 3,759,622 A | | 9/1973 | Miyamoto | 401/104 |
| 4,081,217 A | | 3/1978 | Klaber | 401/131 |
| RE30,346 E | | 7/1980 | Klaber | 401/131 |
| 4,221,490 A | | 9/1980 | Malm | 401/29 |
| 4,533,271 A | | 8/1985 | Sansevero | 401/29 |
| 4,549,827 A | | 10/1985 | Mack | 401/29 |
| 4,669,904 A | | 6/1987 | Kageyama et al. | 401/115 |
| 4,786,197 A | | 11/1988 | Koeln et al. | 401/116 |
| 4,917,519 A | | 4/1990 | White | 401/99 |
| 4,991,988 A | | 2/1991 | Snell | 401/111 |
| 5,004,364 A | | 4/1991 | Tomura et al. | 401/110 |
| 5,044,805 A | | 9/1991 | Kosteniuk | 401/82 |
| 5,342,135 A | | 8/1994 | Tucker | 401/116 |
| 5,547,301 A | * | 8/1996 | Kageyama et al. | 401/112 |
| 5,651,626 A | * | 7/1997 | Chen | 401/99 |
| 5,918,993 A | | 7/1999 | Koyama | 401/106 |
| D425,123 S | | 5/2000 | Creamer | D19/54 |
| D428,057 S | | 7/2000 | Creamer | D19/57 |
| 6,264,388 B1 | | 7/2001 | Wang | 401/109 |
| 6,273,627 B1 | * | 8/2001 | Mittersinker et al. | 401/117 |

FOREIGN PATENT DOCUMENTS

| | | |
|---|---|---|
| DE | 834963 | 3/1952 |
| DE | 1002220 | 4/1955 |
| DE | 1298910 | 7/1969 |
| DE | 26 39 299 | 3/1978 |
| FR | 1307934 | 9/1962 |
| GB | 2078622 A | 1/1982 |
| GB | 2176749 | 1/1987 |
| IT | 508090 | 1/1955 |
| IT | 561022 | 4/1957 |
| SE | 204522 | 5/1966 |
| SU | 1680585 | 9/1991 |
| WO | 82/00614 | 3/1982 |

* cited by examiner

*Primary Examiner*—David J. Walczak
(74) *Attorney, Agent, or Firm*—Pennie & Edmonds LLP

(57) ABSTRACT

A writing instrument includes a barrel defining a channel, an arcuate cam member coupled to the barrel and a writing element in communication with the cam member. The cam member is rotatable between a first position in which a writing end of the writing element is retracted within the channel and a second position in which the writing end of the writing element is extended out of the channel. The cam member rotates about an axis of rotation that is transverse to the longitudinal axis of the writing instrument. Various features which improve the functioning of the writing instrument or cam member may be provided separately or in combination.

38 Claims, 8 Drawing Sheets

WRITING INSTRUMENT

FIELD OF THE INVENTION

The present invention is directed to writing instruments and, in particular, to writing instruments having a retraction mechanism for selectively retracting or extending a writing element. More particularly, the present invention relates to a writing instrument with a cam driven retraction mechanism.

BACKGROUND OF THE INVENTION

Writing instruments are commonly equipped with a retractable writing element. According to one example, a writing instrument may include a press button adapted to control the position of the writing element with respect to the writing instrument barrel. When the press button is pressed toward the writing end of the writing instrument, the writing end of the writing element is forced out of the barrel to allow the writing instrument to be used for writing. After the user is finished writing, the press button may be released, or pressed again, to cause the writing end of the writing element to retract back into the barrel. Repeated use of the writing instrument may cause the mechanism that couples the writing element and the push button to become damaged, thereby causing the writing instrument to work improperly. In addition, the user may inadvertently depress the press button while sliding the writing instrument into a shirt pocket or briefcase, or the press button may be depressed during storage, causing the writing end of the writing element to extend out of the barrel and to create undesired markings on any items, such as the shirt or documents in the briefcase, it may contact.

Another retraction mechanism is a rotating cam or toggle located on the barrel of the writing instrument for controlling the position of the writing element. U.S. Pat. No. 2,896,577 to Merryman et al. describes one example of such a writing instrument, which includes a cam member carried on a fixed pivot at an open end of the barrel, particularly the camming surface. The cam member is exposed to the user and may come into contact with oils, solvents, or other substances that may degrade the materials of the cam member. Also, the open end of the barrel may allow into the barrel dirt, lint, or other contaminants which undesirably affect the operation of the writing instrument. Moreover, the cam member described has a profile with rapid transitions and/or sharp angles that rapidly increase the amount of force the user must apply to the cam member when extending or retracting the writing element, undesirably affecting the perceived feel of the mechanism to the user, and subjecting the cam member and the writing element to high levels of wear.

U.S. Pat. No. 2,988,054 to Yates describes a writing instrument having a pivotless rotating toggle member that cooperates with a bushing to effect retraction and extension of a writing element. The toggle member is located in a cap of the writing instrument and the toggle member and cap have cooperating bearing surfaces that allow respective rotation between the two parts. A lever arm is attached to the bearing surface of the toggle member and extends through a slot in the cap and away from the barrel, and allows the user to manipulate the toggle member. As with the Merryman patent described above, the slot in the cap may allow dirt, lint, or other contaminants into the barrel, which may cause excessive wear between the cooperating bearing surfaces. Moreover, as with the Merryman patent, the toggle has sharply angled transitions that require the user to apply a large force to the lever arm to cause extension and retraction of the writing element, thus increasing the amount of wear on the toggle member and increasing the chances of breaking the lever arm off of the toggle member. Finally, although the construction permits access to the interior, for example to replace the writing element, upon removal of the cap from the barrel, the toggle and bushing may fall out of the cap, thus complicating assembly, and may even become lost.

U.S. Pat. No. 4,917,519 to White et al. discloses a writing instrument having a retraction mechanism that comprises a rotatable wheel eccentrically mounted on an open end of the barrel, and an ink reservoir that snaps into the wheel. The user contacts a radial protrusion on the wheel to retract and to extend the ink reservoir. Similar to the writing instrument of the Merryman patent, oils, solvents, or other substances may come into contact with and degrade the wheel materials, and the open end of the barrel may allow dirt, lint, or other contaminants to enter into the barrel, with a consequent undesirable effect on the operation of the writing instrument. The ink reservoir has opposed projections formed on an end portion thereof that snap fit into complementary recesses in the wheel, thus requiring a special ink reservoir to be used with the writing instrument and increasing the difficulty of replacing the ink reservoir.

U.S. Pat. No. 5,651,626 to Chen describes a writing instrument including a barrel with a rotatable pressure member externally located at one end of the barrel. The pressure member interacts with a spring-loaded cam follower that is mounted around an external surface of the barrel and extends or retracts the ink refill. A finger strip extends away from the pressure member and provides a surface for the user to grasp to rotate the pressure member to extend or to retract a writing element from the barrel. The user may inadvertently contact the finger strip while writing and retract the writing element, or even worse, cause the finger strip to break off of the pressure member.

Thus, there remains a need for a cam-operated writing element retraction mechanism that is durable, is resistant to dirt and other contaminants, provides smooth and easy operation, is comfortable and unobtrusive to hold, and is aesthetically pleasing and fun to use.

SUMMARY OF THE INVENTION

The present invention is directed to a writing instrument with a cam-actuated writing element. The writing instrument includes a barrel having a channel therein for receiving a writing element and a cam member coupled to the barrel. The cam member is rotatable between a first position in which a writing end of the writing element is retracted in the channel and a second position in which the writing end of the writing element is extended out of the channel. The cam member rotates about an axis that is substantially transverse to the longitudinal axis of the writing instrument and/or the direction of movement of the writing element. A biasing element may be associated with the writing element for biasing the writing element toward the cam member such that the non-writing end contacts the camming surface. When the cam member is rotated a predetermined distance away from the second position and toward the first position, the biasing element biases the non-writing end of the writing element toward the camming surface and causes the cam member to rotate to the first position independent of the initial rotational force applied to the cam member. The writing instrument may also include a cam follower disposed in the barrel between the cam and the writing element.

According to one aspect of the invention, the barrel includes a cam housing that encloses the cam member such that the camming surface is protected from the environment and contaminants. The cam member may include first and second sides flanking the camming surface and an axle extending from the first and second sides. An actuator member may be located externally to the cam housing and coupled, through the cam housing, to the sides of the cam member, such that the cam member remains enclosed in and protected by the cam housing.

According to another aspect of the invention, the actuator member may conform to the shape of the barrel and remain adjacent thereto throughout movement of the cam member between the first and second positions. The actuator member may include first and second leg portions flanking the cam member. For instance, the actuator member may be U-shaped. The cam member thus may rotate in a first plane with portions of the actuator member rotating in a second plane substantially parallel to the first plane.

According to yet another aspect of the invention, the cam member may include an arcuate camming surface having first and second neutral portions for receiving an end of the writing element or a cam follower (either being referenced as "the driven element"). Such a camming surface may optionally include a track for receiving and holding in proper alignment the end of the driven element, and may also be polished to decrease friction between the camming surface and the end of the driven element. The camming surface gradually transitions from the first neutral portion to the second neutral portion and is free of any sharp edges or angles. The cam member defines an axis of rotation and a radial distance from the axis of rotation to the camming surface. The radial distance gradually increases in a direction away from the first neutral portion toward the second neutral portion such that movement of the cam member with respect to the writing element effects a smooth transition of the writing element between a retracted position and an extended position.

Finally, according to one more aspect of the invention, the writing instrument may be configured to facilitate replacement or interchanging of the writing element. For instance, the interior channel in the barrel may be configured and dimensioned such that upon accessing and removing the writing element, the cam and, if provided, the cam follower as well are blocked from sliding out of the barrel and do not inadvertently fall out of the barrel.

BRIEF DESCRIPTION OF THE DRAWINGS

The detailed description will be better understood in conjunction with the accompanying drawings, wherein like reference characters represent like elements, as follows.

DETAILED DESCRIPTION OF THE PREFERRED EMBODIMENTS

Figure 1:
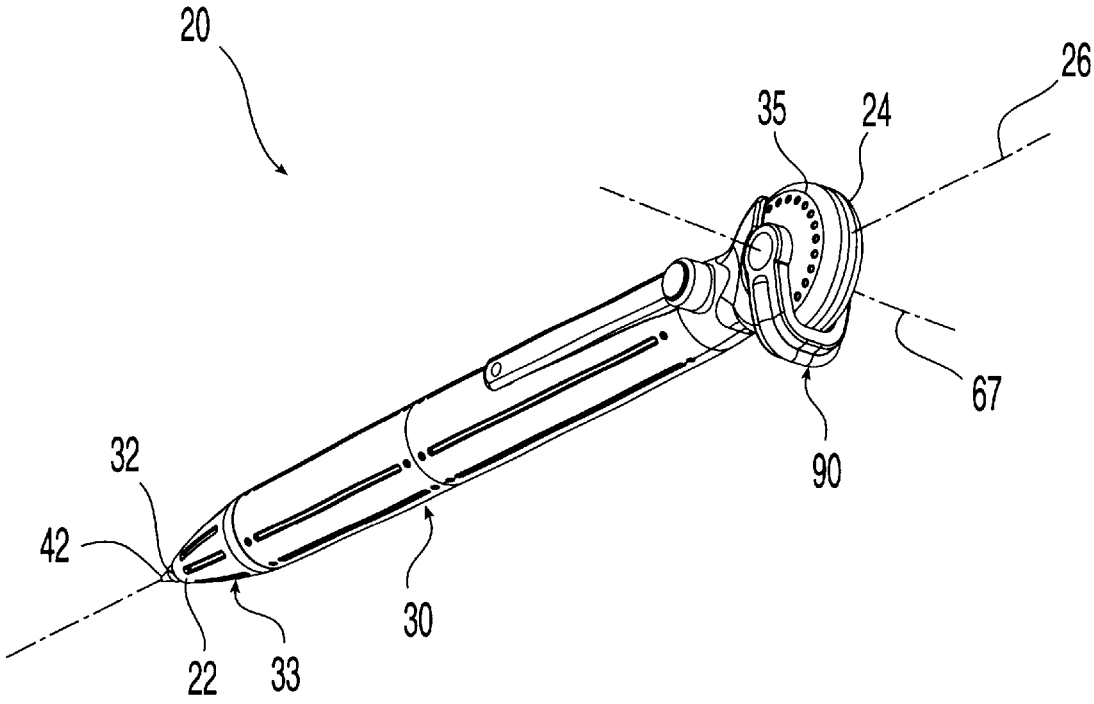
FIG. 1 is a perspective view of a writing instrument according to the present invention.

Referring to FIGS. 1–4, an illustrative writing instrument according to the present invention is shown as writing instrument 20. Writing instrument 20 has a first end 22, referred to herein as writing end 22, and a second end 24, referred to herein as non-writing end 24. The writing instrument 20 defines a longitudinal axis 26 between writing end 22 and non-writing end 24, shown in FIG. 1. Writing instrument 20 generally includes a barrel 30 in the form of an elongated tubular body that defines an aperture 32 at writing end 22 of writing instrument 20.

Figure 4:
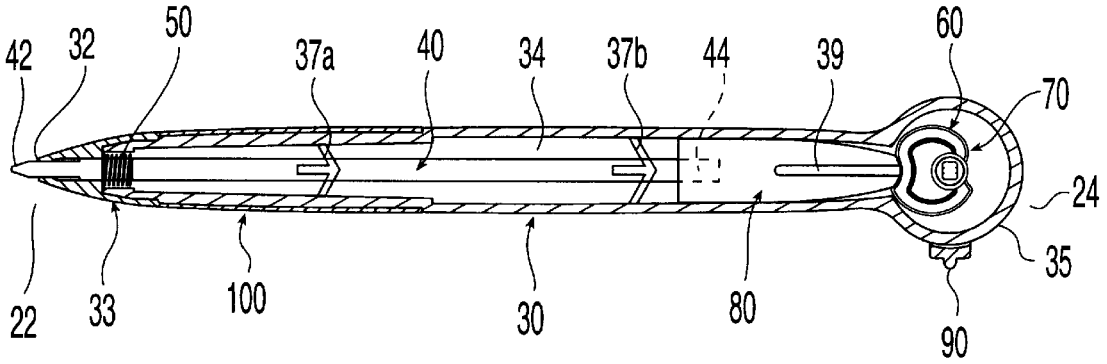
FIG. 4 is a partial cross-sectional view of the writing instrument of FIG. 1, taken along line IV—IV of FIG. 3.

As shown in FIG. 4, barrel 30 has a channel 34 defined therein that extends from aperture 32 toward non-writing end 24 of writing instrument 20. A writing element 40 is disposed in channel 34 and is slidable therein. Standoffs 37*a* and *b* may optionally be provided in channel 34 to center writing element 40 in channel 34. Writing element 40 includes a writing end 42 for writing or marking, and a non-writing end 44. While writing element 40 is shown in FIGS. 1–4 as an ink cartridge with a ball point tip, the present invention is not limited to this type of writing element. Any type of ink cartridge may be used, including, without limitation, a filler-type cartridge, a ballpoint ink cartridge, a free-ink cartridge, or a gel ink cartridge. In fact, any type of writing or marking element known to one of ordinary skill in the art, such as a fountain pen, felt-tip pen, marker, highlighter, lead pencil, mechanical pencil, etc., may be used as writing element 40 according to the present invention.

Still referring to FIG. 4, a biasing element 50 may be provided to bias writing element 40 toward non-writing end 24 of writing instrument 20 such that writing end 42 of writing element 40 is normally retracted and received in channel 34. Biasing element 50 is shown as a spring but may alternatively be an elastomer or any other resilient member known in the art.

Figure 5:
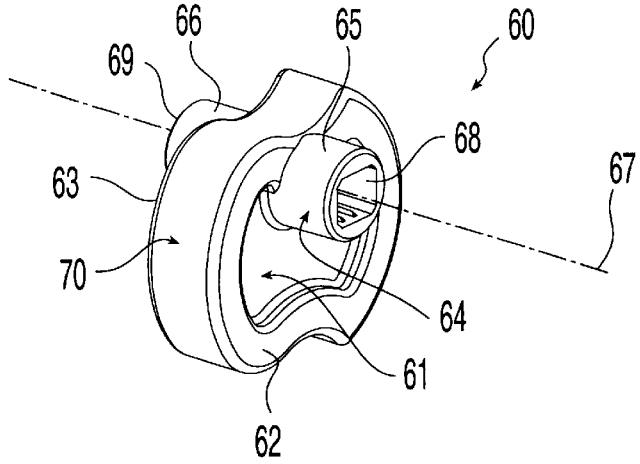
FIG. 5 is a perspective view of one embodiment of a cam member of the writing instrument of FIG. 1.
Figure 6:
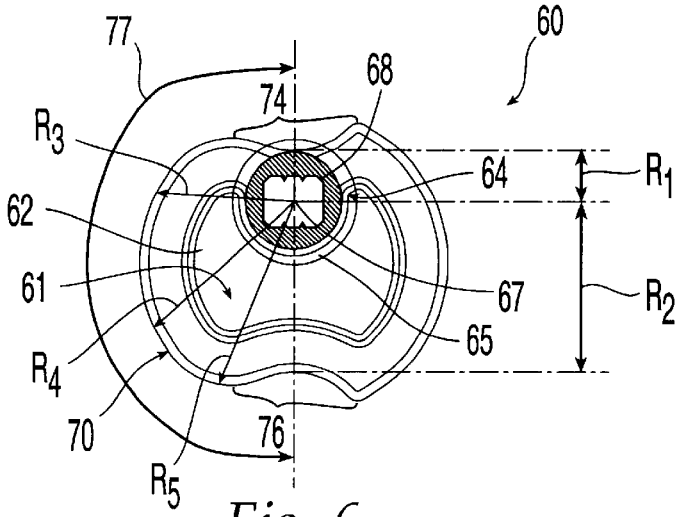
FIG. 6 is a front elevational view of the cam member of FIG. 5.
Figure 7:
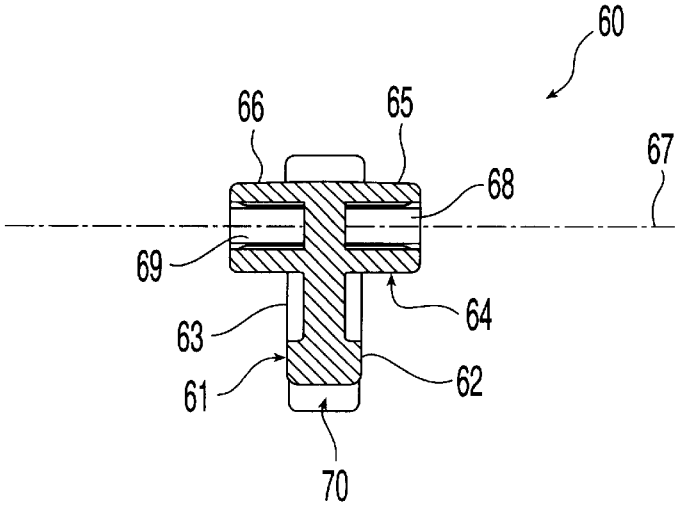
FIG. 7 is a cross-sectional view of the cam member of FIG. 5.

A cam member 60 is provided with respect to writing instrument 20 to affect the position of writing element 40, and includes a camming surface 70. Referring to FIGS. 5–7, one exemplary embodiment of cam member 60 is shown. Cam member 60 includes a body portion 61 that has first and second sides 62, 63, respectively. Cam member 60 may be positioned between first and second sides 62, 63, and may also be oriented substantially perpendicular to at least one of first and second sides 62, 63, however, other configurations are within the scope of the invention. An axle 64 may be provided extending from body portion 61 and defining an axis of rotation 67 of cam member 60, which is located eccentrically with respect to body portion 61. Body portion 61 and axle 64 may be separate pieces, or they may be formed as a unitary piece, such as by molding as a monolithic piece. Axle 64 includes axle ends 65, 66 that extend from first and second sides 62, 63 and optionally through first and second apertures 36, 38 defined in barrel 30 (shown in FIG. 3). Axle 64 supports cam member 60 in barrel 30 and allows rotation thereof about axis of rotation 67. According to one embodiment, axis of rotation 67 is oriented substantially transversely to longitudinal axis 26, and in the illustrated embodiment, is perpendicular to longitudinal axis 26.

According to one embodiment of writing instrument 20, a cam housing 35 may be coupled to barrel 30 proximate the non-writing end 24 of writing instrument 20. As shown in FIGS. 1–4, cam housing 35 may be in the form of an enlarged, generally cylindrical-shaped end of barrel 30 that is oriented transversely to longitudinal axis 26. However, cam housing 35 is not to be limited to the configuration shown and may be of various shapes and sizes, such as rectangular, conical, spherical, pyramidal, or free-form. Although it is not required, cam housing 35 may be enclosed to conceal cam member 60 therein. In this configuration, cam member 60 may be disposed in the cam housing 35 and preferably concealed therein, thus substantially sealing cam member 60 from dust, debris, or any other contaminants. Cam housing 35 may have transparent or translucent windows and/or apertures formed therein to allow viewing of cam member 60 or other components, pictures, designs, holograms, etc., located inside cam housing 35 or barrel 30.

As will be discussed in more detail below, a predetermined movement or rotation of cam member 60 in a first direction moves writing element 40 toward writing end 22 of writing instrument 20 and extends writing end 42 of writing element 40 out of channel 34 through aperture 32. It will be appreciated that cam member 60 may move writing element 40 by directly contacting non-writing end 44 or via a cam follower 80 (shown in FIG. 4) positioned between cam member 60 and writing element 40. Thus, discussions of interactions between cam member 60 and writing element 40 are generally applicable to an embodiment including a cam follower 80. For the sake of simplicity, and with no intentions of being limiting, reference is made to contact between either writing element 40 or cam follower 80 without always referring to the other, such reference being implied and within the scope of the present invention. In this regard, reference to a "driven element," (i.e., a member directly or indirectly driven by cam member 60), may refer to an end of a writing element, or to a cam follower, or to any other element directly or indirectly driven by cam member 60. The non-writing end 44 of writing element 40 may be biased against camming surface 70 under the force of optional biasing element 50. In this configuration, after a predetermined movement or rotation of cam member 60 in a second direction, optional biasing element 50 biases non-writing end 44 against cam member 60 and causes cam member 60 to move or rotate back to its original position automatically, independently of the force applied to cause the initial movement, and writing element 40 is thereby retracted back into channel 34. Such action is alternatively referred to herein as "snapping" action. An actuator member 90 may be coupled to cam member 60 for movement and rotation therewith, and provides the user with a comfortable and convenient surface with which to operate cam member 60, as will be discussed in greater detail below.

The cam member 60 illustrated in FIG. 6 has a camming surface 70 that includes a first neutral portion 74 and a second neutral portion 76. The first and second neutral portions 74, 76 are in the form of concave, slightly indented or recessed sections of the camming surface 70 that may receive non-writing end 44 of writing element 40. When non-writing end 44 is received in first neutral portion 74 or second neutral portion 76, cam member 60 is maintained in the first position or second position, respectively, unless a sufficient force is applied to cam member 60 to rotate cam member 60 such that non-writing end 44 is no longer received in the first or second neutral portion 74, 76. First neutral portion 74 and second neutral portion 76 are located at radial distances $R_1$, $R_2$, respectively, from axis of rotation 67. Radial distance $R_2$ is greater than radial distance $R_1$ such that the relative positions of writing element 40 and barrel 30 are affected by the position of writing element 40 on camming surface 70.

First neutral portion 74 and second neutral portion 76 are separated by an angle 77 about axis of rotation 67. In the embodiment of FIG. 6, angle 77 is about 180°, but other angles, such as 270°, 90°, or 60° may be suitable as well. In the embodiment of FIGS. 5–7, neutral portions 74 and 76 are spaced greater than 90° apart from each other. Such spacing may be up to approximately 180°, as shown, if desired. In combination with a biasing element 50, such spacing of neutral portions 74, 76 enhances the "snapping" action of cam member 60 to the retracted position by providing a longer travel distance between the extended and retracted positions, and thus extending the travel of cam member 60. As a result, the play value of writing instrument 20 is enhanced.

Cam member 60 may be rotated between a first position in which first neutral portion 74 is aligned with channel 34 and a second position in which second neutral portion 76 is aligned with channel 34. When cam member 60 is in the first position, the non-writing end 44 of writing element 40 is received in the first neutral portion 74 and is located at a distance from the axis of rotation 67 corresponding to radial distance $R_1$, which is insufficient to move the writing end 42 of writing element 40 out of channel 34 through aperture 32. In this position, channel 34 defines a first length along longitudinal axis 26 from first neutral portion 74 to aperture 32 that is sufficient to completely receive writing element 40 and writing end 42. This position is referred to as the "retracted position" because the writing element 40, and specifically the writing end 42, are retracted within channel 34. If desired, biasing element 50 aids in holding writing element 40 in the retracted position. When cam member 60 is in the second position, non-writing end 44 is received in the second neutral portion 76, and located at a greater distance away from the axis of rotation 67 corresponding to radial distance $R_2$. Channel 34 thus defines a second length along longitudinal axis 26 that is insufficient to completely receive the entire writing element 40 and writing end 42. This is referred to as the "extended position" because writing end 42 is extended from channel 34 through aperture 32. Thus, when cam member 60 is rotated from the retracted position to the extended position, writing end 42 of writing element 40 is extended from barrel 30 and readied for writing or marking, and vice versa.

The radial distance from axis of rotation 67 to camming surface 70 gradually increases between first neutral portion 74 and second neutral portion 76. For example, as shown in FIG. 6, camming surface 70 may be located at third, fourth, and fifth radial distances $R_3$, $R_4$, $R_5$, respectively, from axis of rotation 67, which radial distances gradually increase in the direction of second neutral portion 76. Thus, $R_5>R_4>R_3$. Preferably, camming surface 70 and first and second neutral portions 74, 76 define a continuous arcuate or curvilinear profile that is substantially free of any interruptions or discontinuities, such as acute, right, or obtuse angles or bends. As a result, the user senses a smooth and fluid motion when rotating cam member 60 between the retracted and extended positions. Also, cam member 60 may be biased to rotate toward the retracted position under the force of non-writing end 44, which is biased against camming surface 70 by biasing element 50. Thus, when cam member 60 is rotated away from the extended position and toward the retracted position sufficiently for non-writing end 44 to exit second neutral portion 76, the cam rapidly rotates, or "snaps" back to the retracted position. This "snapping" action may entertain the user as well as provide hand exercise and therapeutic effects. For example, the user may repeatedly rotate cam member 60 to the extended position and "snap" it back to the retracted position. To increase the smooth movement of cam member 60 between the retracted and extended positions, non-writing end 44 of writing element 40 and camming surface 70, including first and second neutral portions 74, 76, may be smooth or polished, or otherwise treated to reduce the amount of friction between them.

Figure 8:
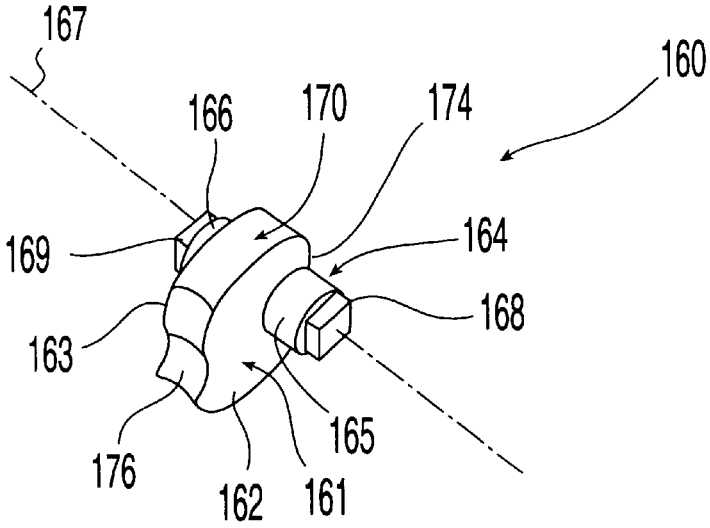
FIG. 8 is a perspective view of another embodiment of the cam member of the writing instrument of FIG. 1.
Figure 9:
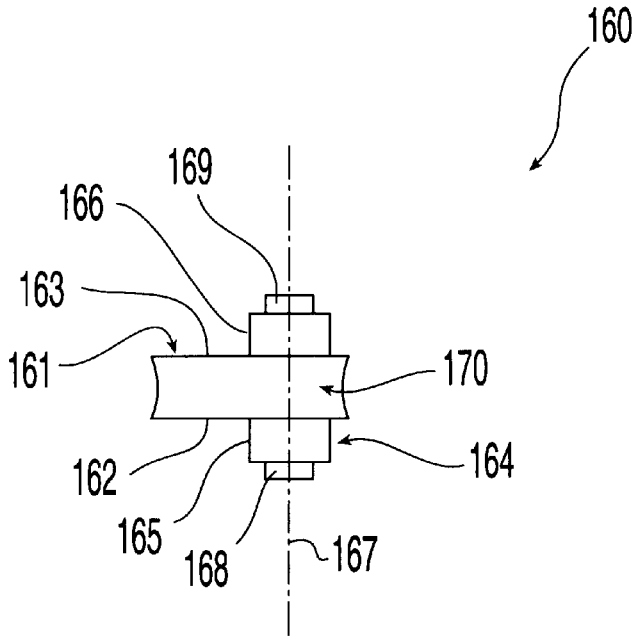
FIG. 9 is a side elevational view of the cam member of FIG. 8.

Referring to FIGS. 8 and 9, a second illustrative embodiment of a cam member 160 is shown. According to this embodiment, camming surface 170, and first and second neutral portions 174, 176, may be slightly concave in a direction perpendicular to the direction of travel along camming surface 170. Thus, camming surface 170 and first and second neutral portions 174, 176 (not shown in FIG. 9) define a concave or recessed track for the non-writing end 44 of writing element 40 to ride in as cam member 160 is rotated. This configuration of camming surface 170 and non-writing end 44 maintains writing element 40 aligned with camming surface 170 and increases the precision of the camming action, and also decreases wear on non-writing end 44 and camming surface 170. In addition, the tracked configuration prevents writing element 46 from becoming misaligned in and rubbing channel 34, thereby avoiding unwanted frictional forces.

According to either embodiment of the cam member described above and shown in the figures, writing element 40 is preferably not mechanically linked to cam member 60, thus allowing a writing element 40 to be removed from and replaced in channel 34 without requiring access to cam member 60. Additionally, this allows the user to conveniently remove and replace writing element 40 without using tools or operating any linkages. Furthermore, because writing element 40 is mechanically independent from cam member 60, rotation of cam member 60 does not impart any lateral movement to writing element 40. Thus, writing element 40 remains aligned in channel 32, thus reducing wear on writing element 40 caused by bending and/or rubbing against channel 32.

As noted above, although non-writing end 44 of writing element 40 may directly contact cam member 60, the use of a cam follower 80 between cam member 60 and writing element 40 may be desirable. The use of cam follower 80 allows optimal materials to be used for cam follower 80 and for cam member 60, thus providing smoother interaction between the two parts and also reducing wear on them. Consequently, the material of writing element 40 becomes less critical, thereby expanding the possible writing elements which may be used. Cam member 60 and cam follower 80 may be made from the same materials, or alternatively from two different materials. These materials may be selected considering factors such as the relative hardness and the relative lubricity of the materials selected for cam member 60 and cam follower 80, and may include delrin, acetyl, polycarbonate, ABS, composites, plastics, and other materials known to one of ordinary skill in the art to be suitable for cam mechanisms. The use of cam follower 80 also allows the cam member 60 and the cam follower 80 to be shaped and configured for optimal interaction regardless of the type of writing element 40 used. This allows almost any type of writing element 40 to be used with the present invention because the writing element 40 does not have to be suitable for interaction with cam member 60.

Figure 10:
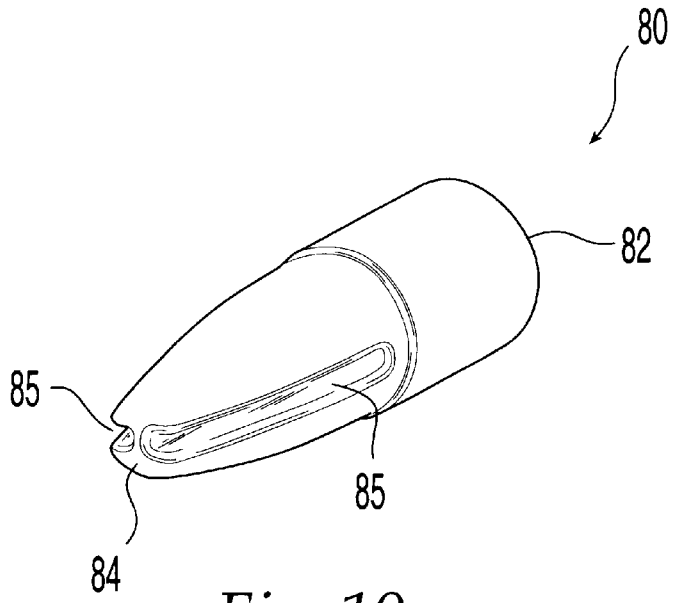
FIG. 10 is a perspective view of one embodiment of a cam follower of the writing instrument of FIG. 1.
Figure 11:
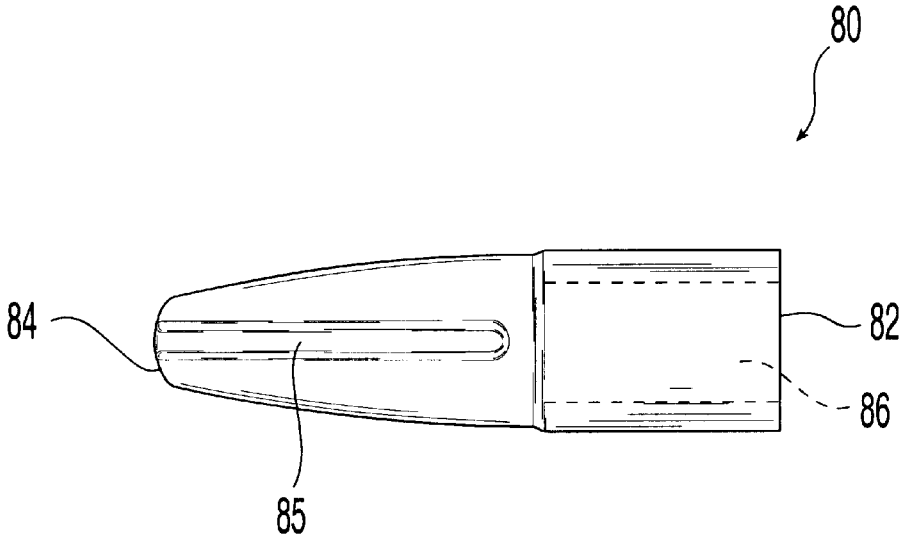
FIG. 11 is a front elevational view of the cam follower of FIG. 10.

Referring to FIGS. 10 and 11, a cam follower 80, which may be provided in one embodiment of writing instrument 20 is shown. As shown in FIG. 4, cam follower 80 may be slidably disposed in channel 34 between the non-writing end 44 of writing element 40 and cam member 60. Cam member 60 interacts with cam follower 80 and translates its movement to writing element 40. Cam follower 80 may be biased toward cam member 60 by writing element 40 under the force of biasing element 50.

Still referring to FIGS. 10 and 11, cam follower 80 has a writing-element-contacting-end 82 and a cam-contacting end 84. Cam-contacting end 84 may be contoured to be received in a contoured camming surface 170, as discussed above in reference to cam member 160. It will be appreciated that cam follower 80 is not to be limited to the configuration shown and cam-contacting end 84 may alternatively be flat, concave, convex, pointed, or any other shape known to one of ordinary skill in the art. One or more slots 85 may be formed in cam follower 80 for receiving one or more projections 39 (shown in FIG. 4) formed on channel 34, or vice versa. Optional slots 85 and projections 39 cooperate to maintain cam follower 80 aligned in channel 34 with camming surface 70. One of ordinary skill in the art, however, will appreciate that any number of cooperating features may be incorporated to maintain cam follower 80 aligned with camming surface 70. Writing-element-contacting-end 82 is shaped to engage a non-writing end 44 of a writing element, and as shown in FIGS. 10 and 11, may include a receptacle 86 for receiving at least a portion of a non-writing end 44 of a writing element. Receptacle 86, which is cup-shaped in the embodiment of FIGS. 10 and 11, may be shaped and dimensioned to engage a non-writing end of any type of writing element known to one of ordinary skill in the art, such as an ink cartridge, an ink tube, a felt tip pen, a fountain pen, a mechanical or lead pencil, a crayon, etc. Furthermore, receptacle 86 may be shaped and dimensioned to hold these writing elements interchangeably, thus allowing the same writing instrument 20 to be used with different types of writing elements.

Figure 12:
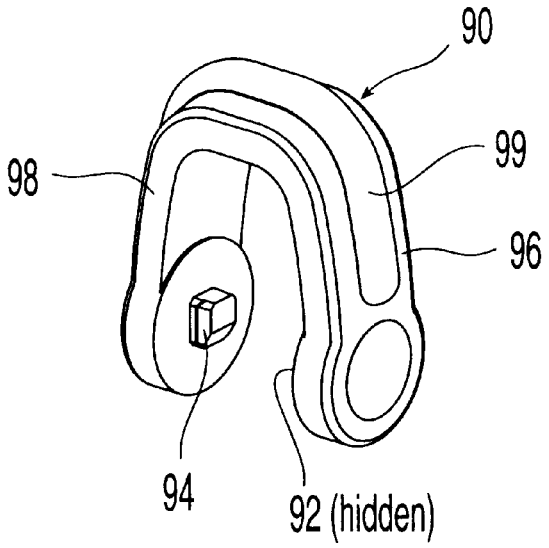
FIG. 12 is a perspective view of one embodiment of an actuator member of the writing instrument of FIG. 1.
Figure 13:
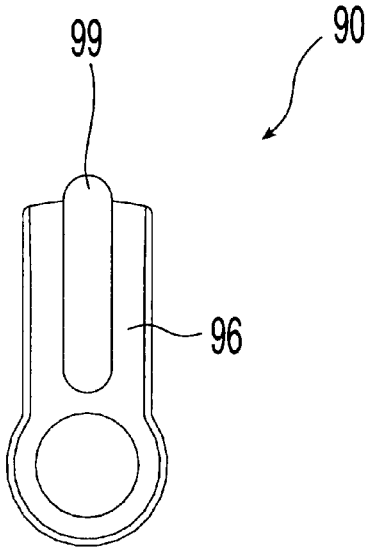
FIG. 13 is a side elevational view of the actuator member of FIG. 12.

Referring to FIGS. 12 and 13, an embodiment of an actuator member that may be used with the present invention is shown as actuator member 90. Actuator member 90 has first and second leg portions 96, 98 for attachment to respective sides 62, 63 of cam member 60. According to one embodiment, actuator member 90 may have first and second connectors 92, 94 formed thereon that allow actuator member 90 to be coupled to corresponding connectors 68, 69 formed on axle ends 65, 66 (shown in FIGS. 5–7). Thus, actuator member 90 may be formed separately from cam member 60 and coupled thereto through cam housing 35. According to this embodiment, actuator member 90 covers apertures 36, 38 in cam housing 35 and completely encloses cam member 60 therein, thus protecting cam member 60 from contaminants. Connectors 92, 94 may be lugs and connectors 68, 69 may be apertures dimensioned for receiving the lugs in locking engagement. The reverse configuration is also within the scope of the present invention. In this embodiment, actuator member 90 should be formed of a flexible, durable material, e.g., polycarbonate or ABS, so that leg portions 96, 98 may resiliently expand to fit over axle ends 65, 66. While connectors 68, 69 and connectors 92, 94 are shown in FIGS. 12 and 13 as being substantially square, they may alternatively be triangular, octagonal, star-shaped, or of any other mating geometry known to one of ordinary skill in the art to couple parts together, preferably such that movement of one imparts movement to the other. In addition, the present invention is not to be limited to the configuration shown, and the actuator member may be coupled to the axle portions 65, 66, to sides 62, 63, or directly to camming surface 70 by glue, screws, pins, or any other type of fastener known to one of ordinary skill in the art. Additionally, cam member 60 and actuator member 90 may alternatively be formed as a single piece.

Actuator member 90 provides the user with a handle or surface with which he or she can easily move or rotate cam member 60, which may be at least partially enclosed in barrel 30 where it is out of sight and protected from the environment and solvents and other contaminants. Also, actuator member 90 provides a longer moment arm for rotating cam member 60 about axis of rotation 67 and, as a result, reduces the amount of force the user must exert to rotate cam member 60.

Figure 2:
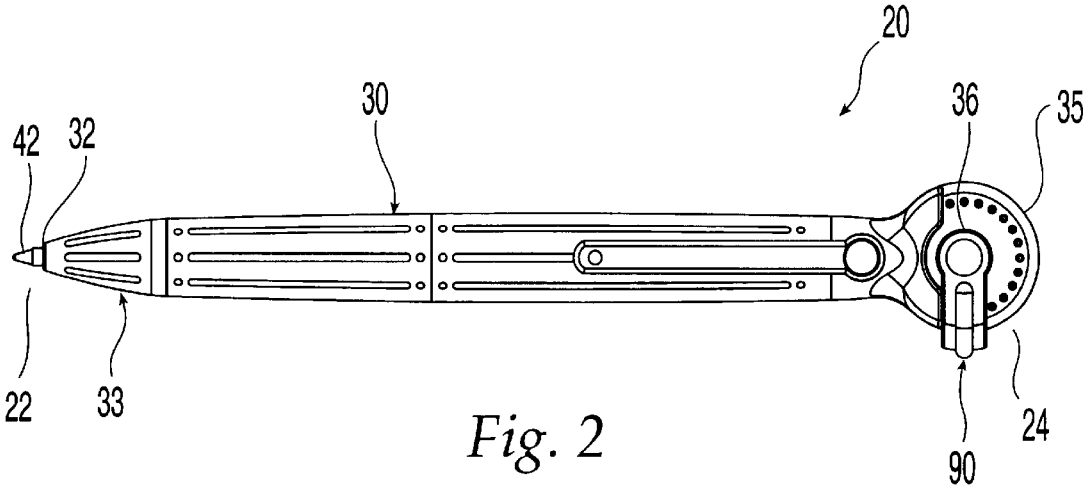
FIG. 2 is a front elevational view of the writing instrument of FIG. 1.
Figure 3:
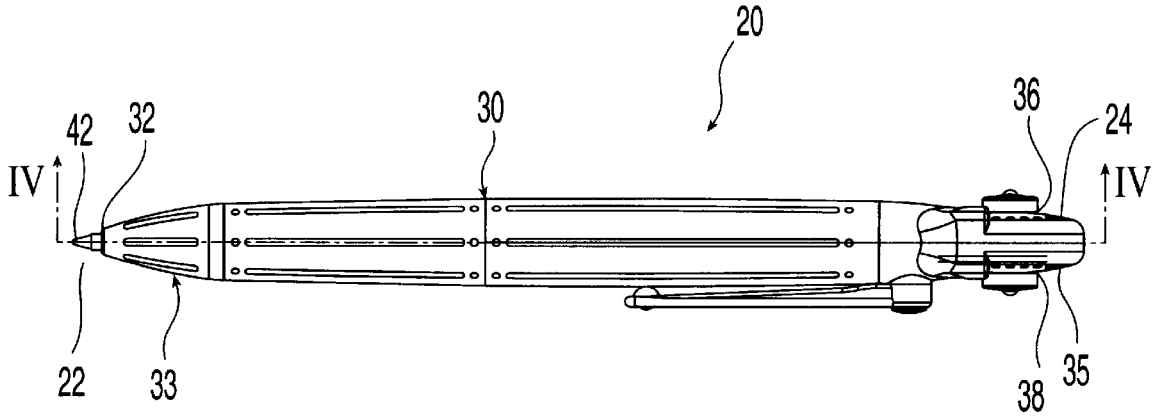
FIG. 3 is a side elevational view of the writing instrument of FIG. 1.

As shown in FIGS. 1 and 2, actuator member 90 may be generally U-shaped or horseshoe-shaped and dimensioned to conform to cam housing 35. Thus, throughout the motion of actuator member 90 between the retracted and extended positions, and back again, actuator member 90 remains close to the surface of cam housing 35 and does not extend significantly therefrom. For example, cam member 60 may rotate in a first plane while first and second leg portions 96, 98 rotate in second and third planes, respectively, that are laterally spaced from the first plane and substantially parallel thereto. This may be accomplished, for example, by attaching actuator member 90 to sides 62, 63 of cam member 60. Furthermore, the first, second, and third planes may be oriented substantially parallel to the flat sides of cam housing 35 such that actuator member 90 remains a substantially constant distance from cam housing 35 throughout its range of motion. Also, the first plane may be substantially parallel to and/or intersect longitudinal axis 26 of writing instrument 20. Actuator member 90 is not to be limited to the configuration shown and may alternatively be, for example, a substantially flat member with a single leg portion that attaches to only one side of cam member 60. According to either embodiment, actuator member 90 preferably maintains a low profile with respect to cam housing 35. This low profile enhances both the appearance of writing instrument 20 as well as the feel of writing instrument 20 to the user. The user does not see any unsightly protrusions, and also does not feel or contact any uncomfortable protrusions when writing. In addition, the low profile of actuator member 90 reduces the risk of catching actuator member 90 on an article of clothing or some other item and inadvertently extending or retracting the writing end 42 of writing element 40. The low profile also reduces the risk of breaking the actuator member 90 off of cam member 60.

As shown in FIGS. 12 and 13, actuator member 90 may have a surface treatment 99 on its surface to provide extra grip for the user, shown as a raised ridge. Surface treatment 99 may alternatively be a series of ridges, protrusions, indentations, knurling, or any other surface treatment known to one of ordinary skill in the art to increase grip.

Figure 14:
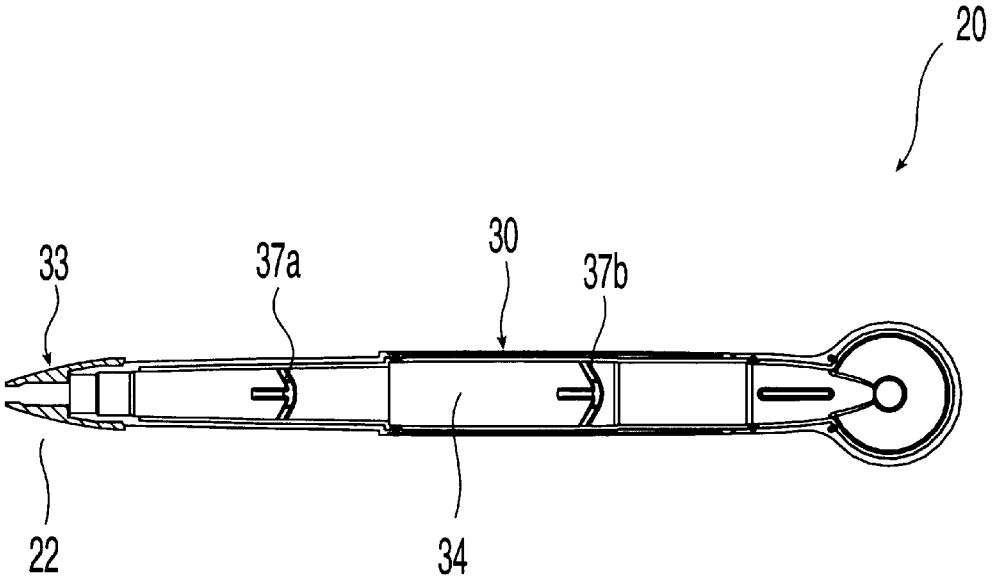
FIG. 14 is an interior view of a barrel of the writing instrument of FIG. 1, with components removed for clarity.

As shown in FIGS. 4 and 14, barrel 30 may be provided with a moveable or removable section to allow channel 32 to be accessed and writing element 40 to be removed therefrom. In the illustrative embodiment shown, barrel 30 includes a front section 33 that is removably associated with barrel 30. Front section may be removably associated with barrel 30 by cooperating threads, cams, snaps, or any other method known by one of ordinary skill in the art. In addition, barrel 30 may be dimensioned and configured such that when channel 32 is opened, writing element 40 may be removable therefrom, but the other components in barrel 30, such as the cam member 70 and cam follower 80 (if provided), are prevented from coming out of barrel 30. Thus, a user can, for example, remove front section 33 from barrel 30 to replace writing element 40 with a new one or one of a different color or type, and the cam follower 80 and cam member 60, along with any other components or items located in barrel 30, will not fall out. This may be accomplished, for example, with a barrel 30 having a channel 34 with a blocking member disposed therein. Alternatively, the channel 34 may have two or more sections, the first section being shaped to house writing element 40 while permitting removal of writing element 40 therefrom, as desired, and the second section being shaped to retain components or items within barrel 30 when writing element 40 is accessed.

Figure 15:
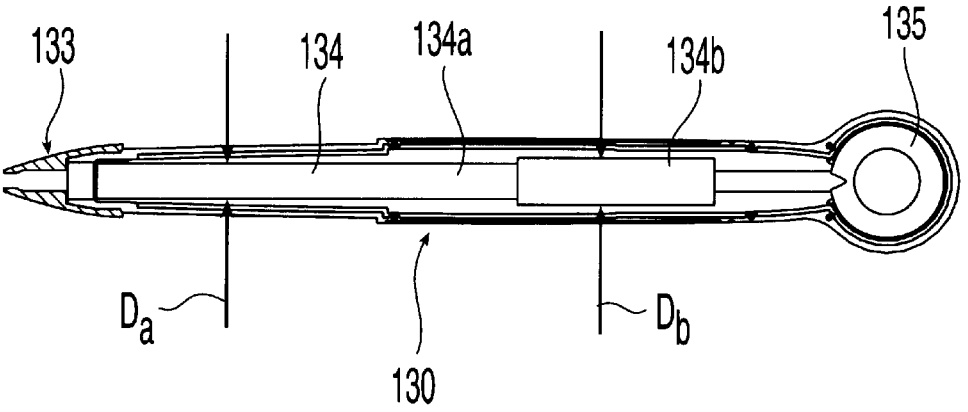
FIG. 15 is an interior view of an alternative embodiment of the barrel part of FIG. 14, with components removed for clarity.
Figure 16:
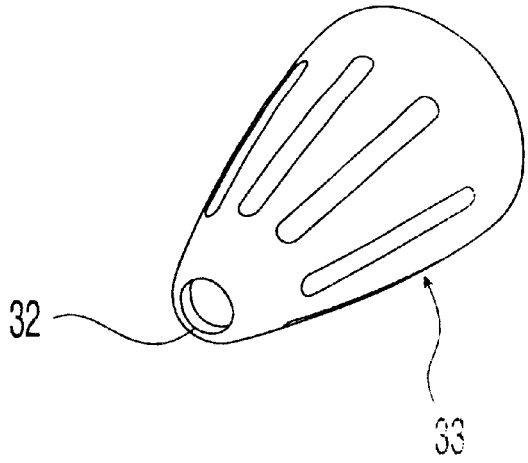
FIG. 16 is a perspective view of one embodiment of a front section of the writing instrument of FIG. 1.

In the embodiment shown in FIGS. 4 and 14, the blocking member is in the form of a standoff 37*b*, located closer to non-writing end 24 of writing instrument 20. Standoff 37*b* prevents cam follower 80 (not shown in FIG. 14) from sliding out of the open portion of channel 34 when accessing writing element 40 (not shown in FIG. 14), while allowing the non-writing end 44 of writing element 40 to pass standoff 37*b* and to interact with cam follower 80 and/or cam member 60 (not shown in FIG. 14). According to an alternate embodiment of barrel 130, shown in FIG. 15, channel 134 may comprise two different sections having different diameters. A first section 134*a* may be located adjacent the open portion of channel 134, and have a diameter $D_a$ that is sufficient to slidably receive writing element 40 (not shown in FIG. 15), but prevents cam follower 80 (not shown in FIG. 15) and cam member 60 (not shown in FIG. 15) from passing therethrough. A second section 134*b* may be located between the first section and the optional cam housing 135, and have a diameter $D_b$ that is sufficient to slidably receive the cam follower 80. Cam follower 80 may thus be slidably disposed in second section 134*b* between the writing element 40 and the cam member 60, but prevented from passing through the first section 134*a* and ultimately prevented from sliding through the open portion of channel 134. Of course, other solutions are within the scope of the invention as will be appreciated by one of ordinary skill in the art.

Using the above-described writing instrument 20, writing element 40 may be easily and conveniently removed and replaced with a new or different writing element. To do so, the user first removes the front portion 33 to open channel 34. Writing element 40 may then be slid out of channel 34, but cam member 60 and cam follower 80 are maintained in channel 34 by standoff 37*b* or the narrowing of first section 134*a*. The user next inserts a new or different writing element, or reinserts the same writing element into channel 34, and replaces front portion 33, completing replacement of the writing element.

Figure 17:
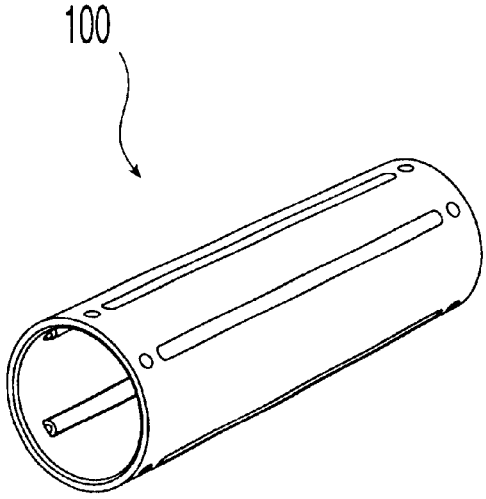
FIG. 17 is perspective view of one embodiment of a grip of the writing instrument of FIG. 1.

A grip 100, shown in FIG. 17, may optionally be provided on barrel 30. Grip 100 may be separately formed and then mounted on barrel 30, or molded directly on barrel 30 and thus bonded thereto. According to the illustrative embodiment shown in FIG. 4, grip 100 is mounted on an optional recessed section of barrel 30 and locked thereon by front section 33. Grip 100 may be formed of rubber, foam, gel, fabric, or any other material to provide a cushioned feel and/or to reduce slippage when using writing instrument 20. Grip 100 may alternatively be plastic, metal, composite, or any other material suitable for providing a desired aesthetic or other effect.

While various descriptions of the present invention are described above, it should be understood that the various features can be used singly or in any combination thereof. In particular, the various inventive concepts need not be used in conjunction and only one of the inventive concepts may be provided without detracting from the invention. Therefore, this invention is not to be limited to only the specifically preferred embodiments depicted herein.

Further, it should be understood that variations and modifications within the spirit and scope of the invention may occur to those skilled in the art to which the invention pertains. For example, a writing instrument according to the present invention may include multiple cam members interacting with multiple writing elements, such as a ball point pen and a mechanical pencil. Accordingly, all expedient modifications readily attainable by one versed in the art from the disclosure set forth herein that are within the scope and spirit of the present invention are to be included as further embodiments of the present invention. The scope of the present invention is accordingly defined as set forth in the appended claims.

What is claimed is:

1. A writing instrument comprising:

a barrel having a channel and an open end through which a writing element is extendable, said barrel defining a longitudinal axis of said writing instrument;

a cam housing associated with said barrel; and a cam member completely enclosed by said cam housing and rotatable about an axis of rotation between a first position defining a first channel length between said cam member and said barrel open end along said longitudinal axis, and a second position defining a second channel length between said cam member and said barrel open end along said longitudinal axis, said second channel length being shorter than said first channel length;

wherein said axis of rotation is substantially transverse with respect to said longitudinal axis.

2. The writing instrument of claim 1, wherein said axis of rotation is substantially perpendicular to said longitudinal axis.

3. The writing instrument of claim 1, wherein said cam housing is disposed on said barrel.

4. The writing instrument of claim 3, wherein said cam housing is substantially cylindrical and defines an axis that is substantially transverse to said longitudinal axis.

5. The writing instrument of claim 1, further comprising an actuator member located external to said cam housing, said actuator member coupled to said cam member for rotation with said cam member and leaving said cam member completely enclosed by said cam housing.

6. The writing instrument of claim 5, further comprising an axle on which said cam member is rotatably mounted; wherein:

said cam housing defines an aperture, and said actuator member is coupled to said axle through said aperture and covers said aperture such that said cam housing is enclosed.

7. The writing instrument of claim 6, wherein:

said axle comprises a first axle end and a second axle end;

said first axle end protrudes through a first aperture in said cam housing;

said second axle end protrudes through a second aperture in said cam housing; and said actuator member is coupled to said first axle end and to said second axle end for rotation with said cam member.

8. The writing instrument of claim 6, wherein said actuator member conforms to the shape of said cam housing and remains adjacent to said cam housing throughout movement of said cam member between the first and second positions.

9. The writing instrument of claim 1, wherein:

said cam member further comprises a camming surface arranged for interacting with a writing element; and said camming surface is completely enclosed in said cam housing.

10. A writing instrument comprising:

a barrel;

a cam member rotatably coupled to said barrel and having:

a first side wall;

a second side wall; and a camming surface for interacting with a writing element, said camming surface positioned between said first and second side walls; and an actuator member extending from one of said side walls and offset from said camming surface for rotation with said cam member.

11. The writing instrument of claim 10, wherein said camming surface is substantially perpendicular to said one of said side walls.

12. The writing instrument of claim 10, wherein said actuator member is coupled to both of said side walls.

13. The writing instrument of claim 10, wherein:

said cam member is housed in a cam housing coupled to said barrel; and said actuator member is shaped to conform to said cam housing.

14. The writing instrument of claim 10, further comprising a cam housing associated with said barrel, wherein said cam member is located inside said cam housing and said actuator member is completely located outside said cam housing.

15. The writing instrument of claim 14, further comprising an axle on which said cam member is rotatably mounted, wherein:

at least a portion of said axle protrudes through an aperture defined in said barrel; and said actuator member is coupled to said portion of said axle.

16. A writing instrument comprising:

a barrel;

a cam member having an axle for rotatably coupling said cam member to said barrel; and an actuator member coupled to said axle;

wherein:

said actuator member is formed separately from said cam member; and a portion of said barrel is located between said actuator member and said cam member.

17. The writing instrument of claim 16, wherein:

said writing instrument further comprises a cam housing associated with said barrel and defining an aperture through which said axle is accessible;

said cam member is located inside said cam housing;

said actuator member is located exterior to said cam housing; and said actuator member covers said aperture such that said cam member is enclosed.

18. The writing instrument of claim 16, wherein:

said axle includes first and second axle ends;

said actuator member is substantially U-shaped and includes first and second leg portions; and each of said leg portions is coupled to one of said axle ends.

19. The writing instrument of claim 18, wherein:

said cam member rotates in a first plane between a retracted position and an extended position; and at least one of said leg portions rotates in a second plane substantially parallel to said first plane.

20. A writing instrument comprising:

a barrel defining a channel; and a cam member rotatably coupled to said barrel and having a camming surface for interaction with a driven element, wherein said camming surface includes a first neutral portion for stabilizing said cam member with respect to said driven element and a second neutral portion for stabilizing said cam member with respect to said driven element;

wherein said first neutral portion, said second neutral portion, and said camming surface define a continuous arcuate profile that is substantially free of any acute or right angles.

21. The writing instrument of claim 20, wherein:

said cam member further defines an axis of rotation and a radial distance from said axis of rotation to said camming surface; and said radial distance gradually increases from said first neutral portion toward said second neutral portion.

22. The writing instrument of claim 21, wherein said first and second neutral portions are angularly displaced from one another about said axis of rotation by an angle of about 180°.

23. The writing instrument of claim 20, wherein at least one of said first and second neutral portions is an indentation.

24. The writing instrument of claim 20, wherein:

said barrel further comprises an open end through which a writing element is extendable;

said cam member is rotatable between a first position in which said first neutral portion is aligned with said channel and defines a first channel length between said first neutral portion and said open end of said barrel, and a second position in which said second neutral portion is aligned with said channel and defines a second channel length between said second neutral portion and said open end of said barrel; and said first channel length is greater than said second channel length.

25. The writing instrument of claim 24, further comprising:

a writing element disposed in said channel and having a writing end and a non-writing end; and a biasing element associated with said writing element for biasing said writing element toward said cam member.

26. The writing instrument of claim 25, wherein when said cam member is rotated away from said second position toward said first position, said biasing element biases said non-writing end of said writing element against said camming surface and causes said cam member to rotate to said first position.

27. The writing instrument of claim 20, wherein said camming surface and said driven element are configured such that said driven element is held in proper alignment with said camming surface.

28. The writing instrument of claim 27, wherein said camming surface defines a track and said driven element rides in said track.

29. The writing instrument of claim 20, wherein said driven element comprises a cam follower disposed in said channel for interacting with said cam member and a writing element.

30. A writing instrument comprising:

a barrel defining a channel;

a driven element disposed in said channel; and a cam member rotatably coupled to said barrel and having a camming surface for interaction with a portion of said driven element, wherein said camming surface includes a first neutral portion for stabilizing said cam member with respect to said driven element and a second neutral portion for stabilizing said cam member with respect to said driven element, said first neutral portion angularly disposed greater than ninety degrees away from said second neutral portion;

wherein said driven element is biased toward said cam member such that substantially immediately after rotation of said second neutral portion out of alignment with said driven element, said cam member rotates to align said first neutral portion with said driven element independently of initial force applied to rotate said cam member second neutral portion out of alignment with said driven element.

31. The writing instrument of claim 30, wherein said first neutral portion is angularly disposed about 180° away from said second neutral portion.

32. The writing instrument of claim 30, wherein at least one of said first and second neutral portions is an indentation.

33. The writing instrument of claim 30, wherein said driven element is a cam follower.

34. The writing instrument of claim 30, wherein said driven element is a writing element.

35. A writing instrument comprising:

a barrel defining a channel therein and having a writing end and a non-writing end, said channel defining a longitudinal axis;

a removable section removably associated with said barrel;

a cam member coupled to said barrel for rotation about an axis substantially perpendicular to said longitudinal axis;

a writing element movable in said channel; and a cam follower located in said channel for interacting with said writing element and said cam member;

wherein said channel is configured such that when said removable section is removed from said barrel, said writing element is removable from said channel, but said cam follower is prevented from exiting said channel.

36. The writing instrument of claim 35, further comprising at least one blocking member in said channel for preventing said cam follower from exiting said channel.

37. The writing instrument of claim 36, wherein said blocking member is a standoff.

38. The writing instrument of claim 36, wherein:

said channel defines a first section with a first diameter, and a second section with a second diameter;

said cam follower is located in said second section; and said first diameter is smaller than said second diameter and prevents said cam follower from passing through said first section.

* * * * *